US009211737B2

(12) United States Patent
Kosuge

(10) Patent No.: US 9,211,737 B2
(45) Date of Patent: Dec. 15, 2015

(54) TAPE PRINTING APPARATUS

(71) Applicant: Seiko Epson Corporation, Tokyo (JP)

(72) Inventor: Shinsaku Kosuge, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/564,992

(22) Filed: Dec. 9, 2014

(65) Prior Publication Data

US 2015/0174926 A1 Jun. 25, 2015

(30) Foreign Application Priority Data

Dec. 25, 2013 (JP) ..... 2013-266731

(51) Int. Cl.
*B41J 11/70* (2006.01)
*B41J 11/66* (2006.01)

(52) U.S. Cl.
CPC ..... *B41J 11/703* (2013.01); *B41J 11/666* (2013.01)

(58) Field of Classification Search
CPC ..... B41J 11/703; B41J 11/007; B41J 11/06; B41J 11/66; B41J 11/70
See application file for complete search history.

(56) References Cited

U.S. PATENT DOCUMENTS

| | | | | |
|---|---|---|---|---|
| 2006/0039738 | A1* | 2/2006 | Murata et al. | 400/615.2 |
| 2006/0216099 | A1* | 9/2006 | Sakano et al. | 400/615.2 |
| 2008/0069622 | A1 | 3/2008 | Sodeyama | |
| 2011/0158733 | A1 | 6/2011 | Kosuge | |

FOREIGN PATENT DOCUMENTS

| | | | |
|---|---|---|---|
| JP | 5-185673 | A | 7/1993 |
| JP | 3350082 | B | 11/2002 |
| JP | 2005-59183 | A | 3/2005 |
| JP | 2011-131312 | A | 7/2011 |

* cited by examiner

*Primary Examiner* — Alessandro Amari
*Assistant Examiner* — Jeremy Delozier
(74) *Attorney, Agent, or Firm* — ALG Intellectual Property, LLC

(57) ABSTRACT

A tape printing apparatus includes: a feed unit configured to feed a tape-like member having a printing tape to be printed and a release tape adhered to the printing tape; a half cutter having a cutting blade configured to cut into the tape-like member and a blade receiving member configured to receive the cutting blade cut into the tape-like member, and configured to cut one of the printing tape and the release tape in a width direction; and a downstream-side restricting portion provided on the downstream side of the feeding direction of the tape-like member, and configured to restrict the movement of the cutting blade cutting into the tape-like member in the downstream side of the feeding direction of the cutting blade.

13 Claims, 12 Drawing Sheets

[RELATED ART]

[RELATED ART]

TAPE PRINTING APPARATUS

CROSS-REFERENCE TO RELATED APPLICATION

This application is based upon and claims the benefit of priority from the prior Japanese Patent Application No. 2013-266731, filed on Dec. 25, 2013; the entire contents of which are incorporated herein by reference.

BACKGROUND

1. Technical Field

The present invention relates to a tape printing apparatus provided with a half cutter.

2. Related Art

In the related art, a tape printing apparatus provided with a feed unit configured to feed a tape-like member having a printing tape to be printed and a release coated paper adhered to the printing tape, and a cutter unit having a cutter blade configured to move in a width direction of the tape-like member and configured to perform full-cutting and half-cutting, and a tape discharging mechanism having a tape discharge roller configured to move the tape-like member toward a discharging side is known. This tape printing apparatus is configured to prevent the user to pull out the tape-like member during a cutting operation such as the full-cutting and the half-cutting by allowing the tape discharge roller to rotate only after the termination of full-cutting action (see JP-A-2011-131312). The term "full-cutting" means an operation to cut the printing tape and the release coated paper of the tape-like member together. The term "half-cutting" means an operation to cut only one of the printing tape and the release coated paper. In the case where the half cutter configured to perform the half-cutting includes a cutting blade configured to cut into the tape-like member and a blade receiving member configured to receive the cutting blade after cutting, if the cutting blade cutting into the tape-like member moves toward an upstream side or a downstream side of a feeding direction, the tape-like member is moved toward the upstream side or the downstream side of the feeding direction so as to be dragged by the cutting blade.

SUMMARY

An advantage of some aspect of the invention is to provide a tape printing apparatus capable of restraining the tape-like member from moving in an upstream side or a downstream side of a feeding direction at the time of the half-cutting action.

A tape printing apparatus according to an aspect of the invention includes: a feed unit configured to feed a tape-like member having a printing tape to be printed and a release tape adhered to the printing tape; a half cutter having a cutting blade configured to cut into the tape-like member and a blade receiving member configured to receive the cutting blade cut into the tape-like member, and configured to cut one of the printing tape and the release tape in a width direction; and a cutter restricting portion having at least one of an upstream-side restricting portion provided on an upstream side of a feeding direction of the tape-like member with respect to the cutting blade and configured to restrict a movement of the cutting blade cut into the tape-like member in the upstream side of the feeding direction, and a downstream-side restricting portion provided on a downstream side of the feeding direction of the tape-like member with respect to the cutting blade and configured to restrict the movement of the cutting blade cut into the tape-like member in the downstream side of the feeding direction.

In this configuration, in the case where the cutter restricting portion has the upstream-side restricting portion, even when a force to move the cutting blade cut into the tape-like member toward the upstream of the feeding direction is applied to the cutting blade, the cutting blade is restricted from moving in the upstream side of the feeding direction. Accordingly, the tape-like member is restrained from moving in the upstream side of the feeding direction at the time of the half-cutting action. Also, in the case where the cutter restricting portion has the downstream-side restricting portion, even when a force to move the cutting blade cut into the tape-like member toward the downstream of the feeding direction is applied to the cutting blade, the cutting blade is restricted from moving in downstream side of the feeding direction. Accordingly, the tape-like member is restrained from moving in the downstream side of the feeding direction at the time of the half-cutting action.

It is preferable that the tape printing apparatus further includes a printhead configured to perform printing on the printing tape fed by the feed unit, and the cutting blade cuts into the tape-like member in the middle of printing on the printing tape by the printhead.

In this configuration, the tape-like member is restrained from moving toward the upstream side or downstream side of the feeding direction at the time of the half-cutting action, and hence generation of a gap between an image printed before the half-cutting action and an image printed after the half-cutting action is restrained even though the half-cutting action is performed during the middle of printing.

It is preferable that the tape printing apparatus further includes a cutter drive unit configured to drive the cutting blade, the cutting blade includes a blade portion provided with the blade, a power input unit to which motive power of the cutter drive unit is input, and the cutter restricting portion restrains a movement of the cutting blade by coming into contact with the blade portion.

In this configuration, the cutter restricting portion comes into contact with the blade portion at the time of the half-cutting action, so that the movement of the cutting blade in the upstream side or the downstream side of the feeding direction may be restrained effectively.

It is preferable that the cutting blade is supported by the supporting shaft at a base end portion of the blade portion, and the cutter restricting portion comes into contact with a distal end portion of the blade portion so that the movement of the cutting blade is restricted.

In this configuration, since the cutting blade is supported by the supporting shaft at the base end portion of the blade portion, an amount of movement is larger at the distal end portion of the blade portion in comparison with the base end portion of the blade portion if there is no cutter restricting portion. However, the cutter restricting portion comes into contact with the distal end portion of the blade portion at the time of the half-cutting action, so that the movement of the cutting blade to the upstream side or the downstream side of the feeding direction is effectively restrained.

It is preferable that the cutter restricting portion includes the downstream-side restricting portion.

It is preferable that the tape printing apparatus further includes a printhead configured to performing printing on the printing tape, the feed unit includes a roller drive shaft configured to drive a roller configured to rotate to feed the tape-like member nipped with the printhead, and the printhead and the roller drive shaft are provided on the upstream side of the feeding direction with respect to the half cutter.

In this configuration, the tape-like member is nipped between the printhead and the roller on the upstream side of the feeding direction with respect to the half cutter. Therefore, even when the cutting blade cutting into the tape-like member moves toward the upstream side of the feeding direction, the tape-like member can hardly move toward the upstream side of the feeding direction. In contrast, in the case where the cutting blade cutting into the tape-like member moves toward the downstream side of the feeding direction, the tape-like member can easily move toward the downstream side of the feeding direction. In the case as well, since the cutter restricting portion has the downstream-side restricting portion, the cutting blade cutting into the tape-like member is restricted from moving in the downstream side of the feeding direction. Accordingly, the tape-like member is restrained from moving in the downstream side of the feeding direction at the time of the half-cutting action.

It is preferable that the tape printing apparatus further includes a cutter drive unit configured to drive the cutting blade, and the cutting blade includes the blade portion provided with the blade, and the power input unit to which the motive power of the cutter drive unit is input, and an output member of the cutter drive unit engaged the power input unit is provided on the upstream side of the feeding direction with respect to the power input unit.

In this configuration, the cutting blade can hardly move toward the side where the output member is provided with respect to the power input unit, that is, toward the upstream side of the feeding direction, but can easily move toward the downstream side of the feeding direction when cutting into the tape-like member. In contrast, since the cutter restricting portion has the downstream-side restricting portion, the cutting blade cutting into the tape-like member is restricted from moving in downstream side of the feeding direction. Accordingly, the tape-like member is restrained from moving in the downstream side of the feeding direction at the time of the half-cutting action.

It is preferable that the tape printing apparatus further includes a full cutter configured to cut the tape-like member and a tape discharging unit provided on the downstream side of the feeding direction with respect to the half cutter and configured to discharge the tape-like member cut by the full cutter out of the apparatus, and the tape discharging unit includes a discharge roller configured to rotate to feed the tape-like member, and a roller holder configured rotatably support the discharge roller, and the downstream-side restricting portion is provided on the roller holder.

In this configuration, the downstream-side restricting portion may be provided by utilizing the roller holder.

It is preferable that the tape printing apparatus further includes an apparatus case as an outer shell of the apparatus, and the roller holder is formed of a material having a higher sliding property than the apparatus case.

In this configuration, since the roller holder having the downstream-side restricting portion provided thereon is formed of the material having a higher sliding property, a sliding resistance between the cutting blade and the downstream-side restricting portion is small when the cutting blade cuts into the tape-like member. Therefore, the cutting blade can be made cut into the tape-like member desirably. Furthermore, since the roller holder is formed of the material having a higher sliding property, the tape-like member is restrained from being adhered to the roller holder.

BRIEF DESCRIPTION OF DRAWINGS

The invention will be described with reference to the accompanying drawings, wherein like numbers reference like elements.

DESCRIPTION OF EXEMPLARY EMBODIMENTS

Referring now to the attached drawings, a tape printing apparatus of an embodiment of the invention will be described. The tape printing apparatus of the embodiment is configured to print an image on a tape-like member fed from a tape cartridge.

In the following description, expressions "up", "down", "left", "right", "front", and "rear" are used. However, these directions are for description only, and the embodiment of the invention is not limited to these directions.

Figure 1:
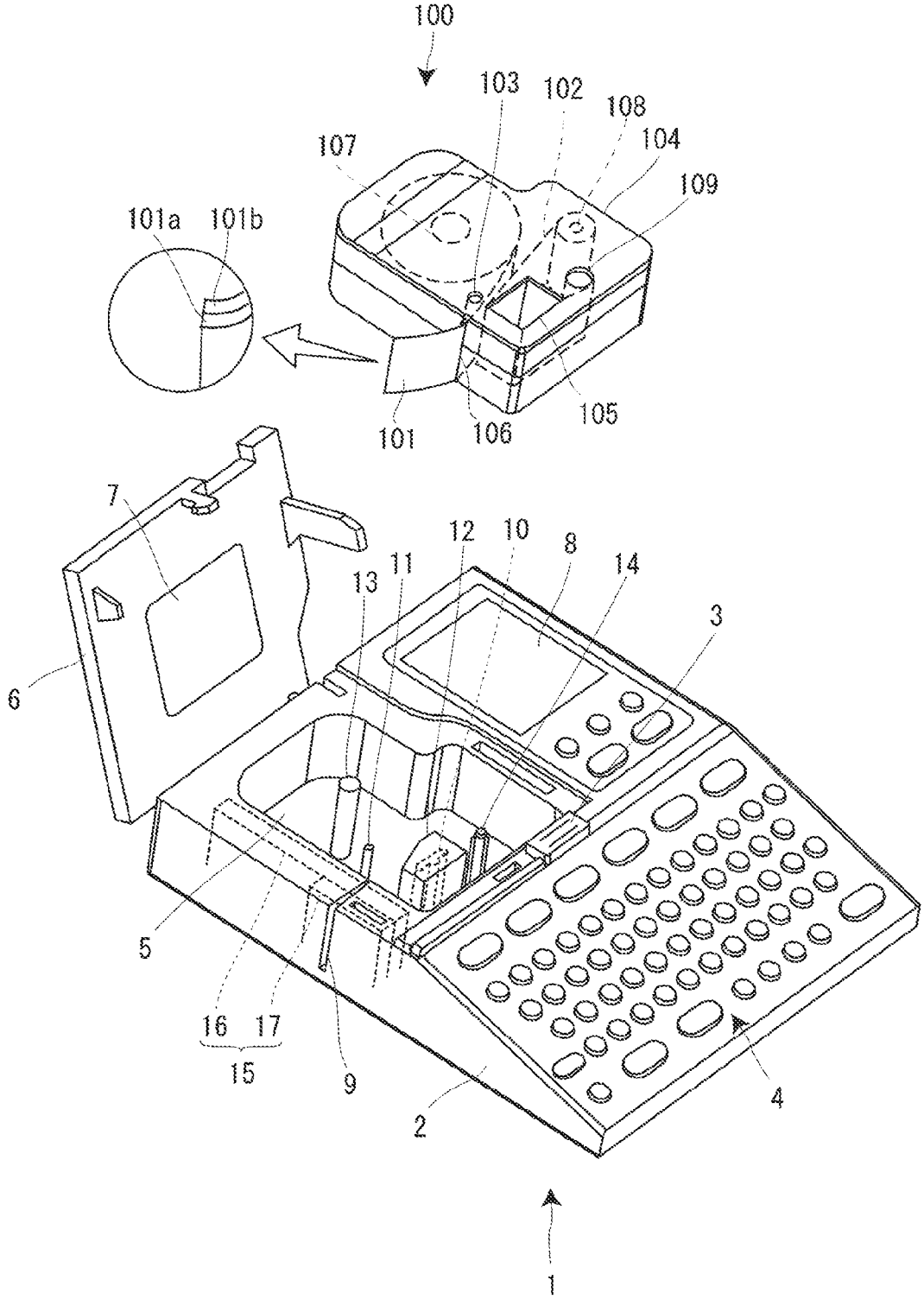
FIG. 1 is an appearance perspective view of a tape printing apparatus and a tape cartridge to be mounted thereon of a first embodiment of the invention, illustrating a state in which an opening-and-closing lid is opened.

First of all, a tape cartridge to be mounted on the tape printing apparatus will be described. As illustrated in FIG. 1, a tape cartridge 100 includes a tape-like member 101, an ink ribbon 102, a platen roller 103, and a cartridge case 104 housing these members. The cartridge case 104 is provided with a head opening 105 having a rectangular shape in plan view and allowing a printhead 10, described later, to pass therethrough. In addition, the cartridge case 104 is provided with a slit-shaped tape feeding port 106 on a left side wall thereof to allow the printed tape-like member 101 to be fed out of the cartridge case 104.

The platen roller 103 is an example of a "roller configured to rotate to feed the tape-like member" in the appended claims.

The tape-like member 101 includes a printing tape 101*a* to be printed on a front surface thereof, and a release tape 101*b* adhered to a back surface of the printing tape 101*a*. A surface of the release tape 101*b* to be adhered to the printing tape 101*a* is silicone-coated, for example, so as to allow the user to separate the release tape 101*b* easily from the printing tape 101*a*. The tape-like member 101 is stored in the cartridge case 104 in a state of being wound on a tape core 107 with the printing tape 101*a* facing outside so as to be fed. The tape-like member 101 fed from the tape core 107 moves together with the ink ribbon 102 in an overlapped manner at a portion of a head opening 105, and then is fed from the tape feeding port 106 out of the cartridge case 104.

The ink ribbon 102 is wound around a ribbon feed core 108 so as to be capable of being fed. The ink ribbon 102 fed from the ribbon feed core 108 moves with the tape-like member 101 in an overlapped manner at a portion of the head opening 105, and is wound around a ribbon winding core 109.

The platen roller 103 faces the printhead 10 which is inserted into the head opening 105 in a state of being mounted on a tape printing apparatus 1. The platen roller 103 rotates by being driven by the tape printing apparatus 1, and rotates to feed the tape-like member 101 and the ink ribbon 102 nipped in cooperation with the printhead 10.

Figure 2:
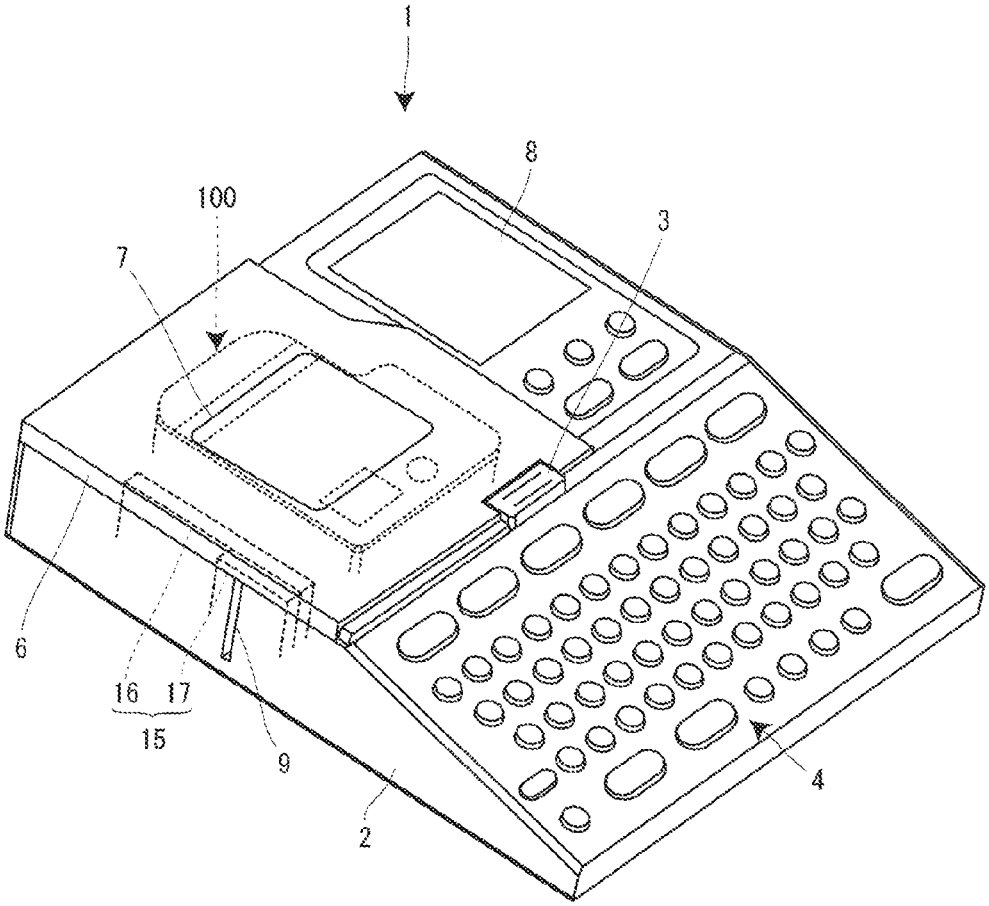
FIG. 2 is an appearance perspective view of the tape printing apparatus and the tape cartridge to be mounted thereon, illustrating a state in which the opening-and-closing lid is closed.

Subsequently, the tape printing apparatus 1 will be described. As illustrated in FIG. 1 and FIG. 2, the tape printing apparatus 1 has an outer shell formed by an apparatus case 2 having a substantially square shape like a wedge. The apparatus case 2 is formed of, for example, a resin, and among others, ABS resin (Acrylonitrile Butadiene Styrene copolymer) is preferably used.

A keyboard 4 having various keys is provided on a front half of an upper surface of the apparatus case 2. An opening-and-closing lid 6 configured to open and close a cartridge mounting portion 5, on which the tape cartridge 100 is demountably mounted, on a left portion of a rear half of the upper surface of the apparatus case 2 is provided. An inspection window 7 for visually confirming mounting/non-mounting of the tape cartridge 100 is formed at a substantially center portion of the opening-and-closing lid 6. A lid member opening button 3 is provided on a near side of the opening-and-closing lid 6 for opening the opening-and-closing lid 6. On the other hand, a square shaped display 8 configured to display an input result or the like from the keyboard 4 is built into a right portion of the rear half of the upper surface of the apparatus case 2. A slit-shaped tape discharge port 9 continuing to the cartridge mounting portion 5 is provided on a left side portion of the apparatus case 2.

Although illustration is omitted, a circuit board having a control circuit is built therein is mounted in an interior of the apparatus case 2. The control circuit controls drive of respective parts on the basis of a result input from the keyboard 4 and a result of detection by sensors provided in respective parts.

The thermal type printhead 10 is provided at a left front corner of the cartridge mounting portion 5 so as to protrude therefrom. The printhead 10 is covered with a head cover 12. The tape cartridge 100 is mounted on the cartridge mounting portion 5 so that the head cover 12 is inserted into the head opening 105 of the tape cartridge 100. The printhead 10 starts heat-generating drive on the basis of a result input from the keyboard 4 and prints a desired image on the printing tape 101*a*.

Furthermore, the cartridge mounting portion 5 includes a platen drive shaft 11 extending upright so as to face the printhead 10. The platen drive shaft 11 engages the platen roller 103 in the interior of the tape cartridge 100 and rotates the platen roller 103. Accordingly, the tape-like member 101 fed from the tape cartridge 100 is fed leftward in the drawing, and is fed from the tape discharge port 9 out of the apparatus.

The platen drive shaft 11 is an example of a "roller drive shaft" in the appended claims. The platen drive shaft 11 constitutes part of a "feed unit" in the appended claims together with a feed drive unit 40, described later.

At a substantially center portion of the cartridge mounting portion 5, a guide projection 13 is provided so as to protrude therefrom. The guide projection 13 guides mounting of the tape cartridge 100. The cartridge mounting portion 5 includes a winding drive shaft 14 provided so as to extend upright therefrom. The winding drive shaft 14 engages the ribbon winding core 109 and rotates the ribbon winding core 109.

Figure 3:
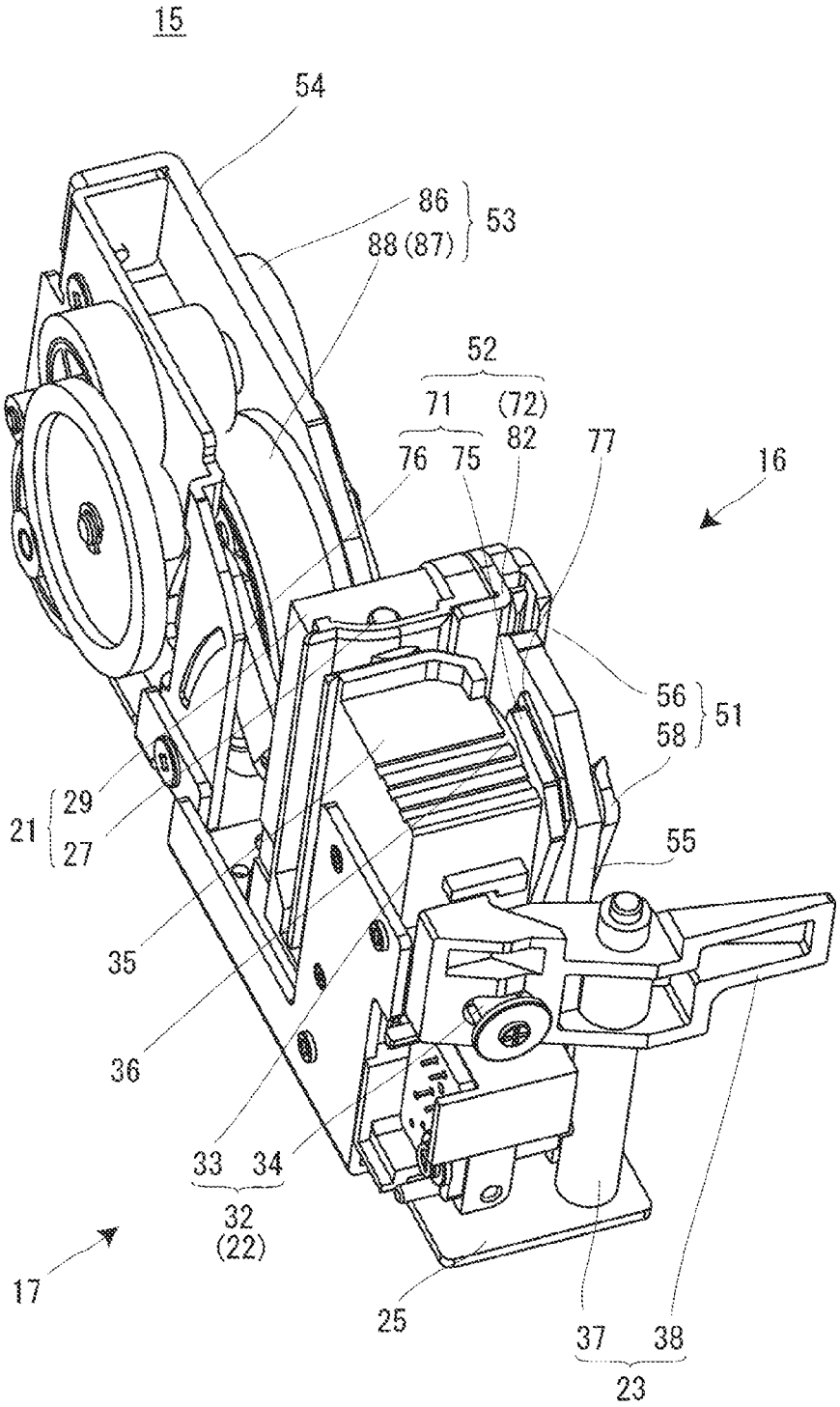
FIG. 3 is a perspective view of a cutting-and-discharging unit.

A cutting-and-discharging unit 15 is provided between the cartridge mounting portion 5 and the tape discharge port 9. The cutting-and-discharging unit 15 includes a cutting unit 16 and a tape discharging unit 17 provided on the downstream side of the tape-like member 101 of the feeding direction with respect to the cutting unit 16. Although the detailed description will be given later, the cutting unit 16 includes a full cutter 51 and a half cutter 52 provided on the downstream side of the feeding direction of the full cutter 51 (see FIG. 3). The full cutter 51 is configured to cut both of the printing tape 101*a* and the release tape 101*b* of the tape-like member 101, that is, performs full-cutting. The half cutter 52 cuts only one of the printing tape 101*a* and the release tape 101*b* of the tape-like member 101 (the printing tape 101*a* in this embodiment), that is, performs half-cutting. In contrast, the tape discharging unit 17 includes a discharge drive roller 28 and a discharge driven roller 31, and rotates to feed the tape-like member 101 cut by the full cutter 51, that is, a tape strip 111 from the tape discharge port 9 out of the apparatus (see FIGS. 9A to 9E).

Referring now to FIG. 3 to FIG. 6, the tape discharging unit 17 will be described. The tape discharging unit 17 includes a drive roller unit 21 and a driven roller unit 22 provided so as to oppose each other, an interlocking mechanism 23 provided on a back surface side of the driven roller unit 22, and a discharge frame 25 configured to support these members. The tape-like member 101 passes between the drive roller unit 21 and the driven roller unit 22. The drive roller unit 21 is provided on the side of the release tape 101*b* of the tape-like member 101 passing therethrough, and the driven roller unit 22 is provided on the side of the printing tape 101*a* of the tape-like member 101 passing therethrough. The cutting unit 16 is fixed to the discharge frame 25 via the drive roller unit 21. In other words, the cutting unit 16 and the tape discharging unit 17 are unitized as the cutting-and-discharging unit 15. The discharge frame 25 is fixed to an apparatus frame 43 provided in a lower space of the cartridge mounting portion 5.

The drive roller unit 21 includes a drive roller shaft 27 provided so as to extend upright from the discharge frame 25, the discharge drive roller 28 rotatably supported by the drive roller shaft 27, and a drive roller holder 29 surrounding the discharge drive roller 28. The discharge drive roller 28 is provided with a roller gear portion (not illustrated) at a lower end portion thereof. Motive power is input to the roller gear portion from the feed drive unit 40, which will be described later, so that the discharge drive roller 28 rotates.

The drive roller holder 29 is formed into a substantially gate-shape opened on the driven roller unit 22 side and the opposite side thereof. The drive roller holder 29 is fixed to the discharge frame 25. The cutting unit 16 is fixed to the discharge frame 25 via a wall portion on the upstream side of the feeding direction of the drive roller holder 29. The drive roller holder 29 is preferably formed of a material having higher sliding property than the apparatus case 2, and for example, POM resin (polyoxymethylene) is preferably used. Accordingly, adhesion of the tape-like member 101 to the drive roller holder 29 may be restrained.

The driven roller unit 22 includes the discharge driven roller 31, and a driven roller holder 32 configured to rotatably hold the discharge driven roller 31. The discharge driven roller 31 constitutes a nip roller together with the discharge drive roller 28, and rotates to feed the nipped tape-like member 101. Although detailed description will be described later, the discharge driven roller 31 is configured to be movable forward and backward between a nip position where the tape-like member 101 can be nipped with the discharge drive roller 28 and a separated position where the tape-like member 101 is separated from the discharge drive roller 28.

The discharge drive roller 28 and the discharge driven roller 31 are an example of a "discharge roller" in the appended claims.

The driven roller holder 32 is provided with a fixed holder 33 fixed to the discharge frame 25 and a movable holder 34 housed so as to be slidable forward and backward with respect to the fixed holder 33. The movable holder 34 includes a column-shaped interlocking rod protruding toward the interlocking mechanism 23.

The fixed holder 33 is formed into a box shape opening on the driven roller unit 22 side and the upstream side of the feeding direction. An insertion hole 39 which allows the interlocking rod of the movable holder 34 to pass therethrough is formed on the interlocking mechanism 23 side of the fixed holder 33. A downstream-side restricting portion 36 having a substantially flat trapezoidal shape in plan view is formed on a side surface of an upper wall portion 35 of the fixed holder 33 in the upstream side of the feeding direction so as to protrude in a window-roof shape. A distal end surface 36*a* (see FIG. 5) of the downstream-side restricting portion 36 comes into contact with a cutting blade 71 (described later) of the half cutter 52.

The movable holder 34 rotatably supports the discharge driven roller 31. The fixed holder 33 rotatably supports the discharge driven roller 31 via the movable holder 34. The movable holder 34 slides forward and backward with respect to the fixed holder 33, so that the discharge driven roller 31 comes into and out of contact with the drive roller unit 21.

The fixed holder 33 and the movable holder 34 are preferably formed of a material having higher sliding property than the apparatus case 2 in the same manner as the drive roller holder 29 described above, and for example, POM resin is preferably used. Accordingly, the tape-like member 101 may be restrained from adhering to the fixed holder 33 and the movable holder 34.

The interlocking mechanism 23 includes a pivotal shaft 37 extending upright from the discharge frame 25 and a pivotal member 38 pivotably supported by the pivotal shaft 37. An activation projection (not illustrated) protruding from a back surface of the opening-and-closing lid 6 engages and disengages the pivotal member 38 on the upstream side of the feeding direction with respect to a center of rotation. An interlocking rod of the movable holder 34 engages the pivotal member 38 on the downstream side of the feeding direction with respect to the center of rotation.

When the opening-and-closing lid 6 closes the cartridge mounting portion 5, the activation projection engages the pivotal member 38, and the pivotal member 38 rotates clockwise when viewed from above. Accordingly, the movable holder 34 gets closer to the drive roller unit 21, and the discharge driven roller 31 moves to the nip position. In contrast, when the opening-and-closing lid 6 opens the cartridge mounting portion 5, the activation projection disengages the pivotal member 38, and the pivotal member 38 rotates counterclockwise when viewed from above. Accordingly, the movable holder 34 moves away from the drive roller unit 21, and the discharge driven roller 31 moves to the separated position. In this manner, the interlocking mechanism 23 moves the discharge driven roller 31 between the nip position and the separated position in conjunction with the opening and closing of the opening-and-closing lid 6.

Figure 6:
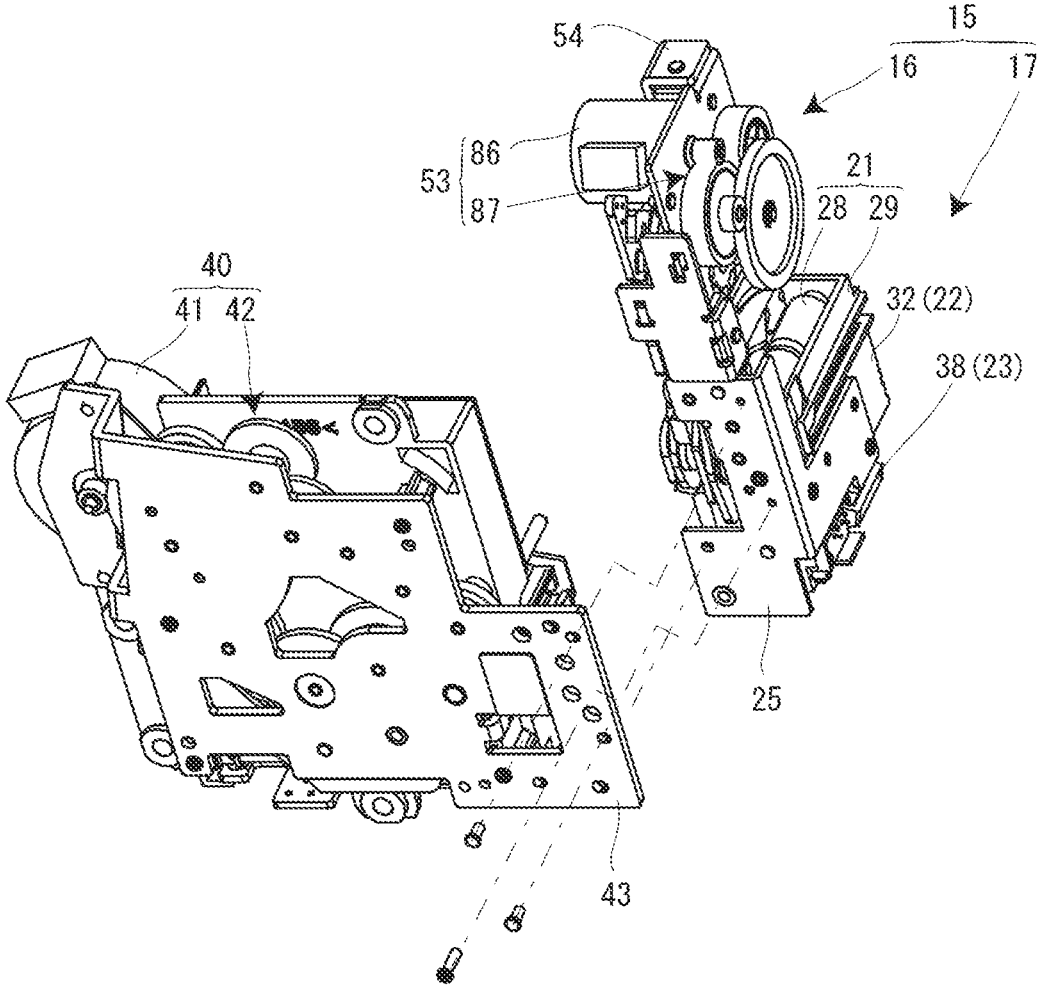
FIG. 6 is a perspective view of the cutting-and-discharging unit and a feed drive unit.
Figure 7:
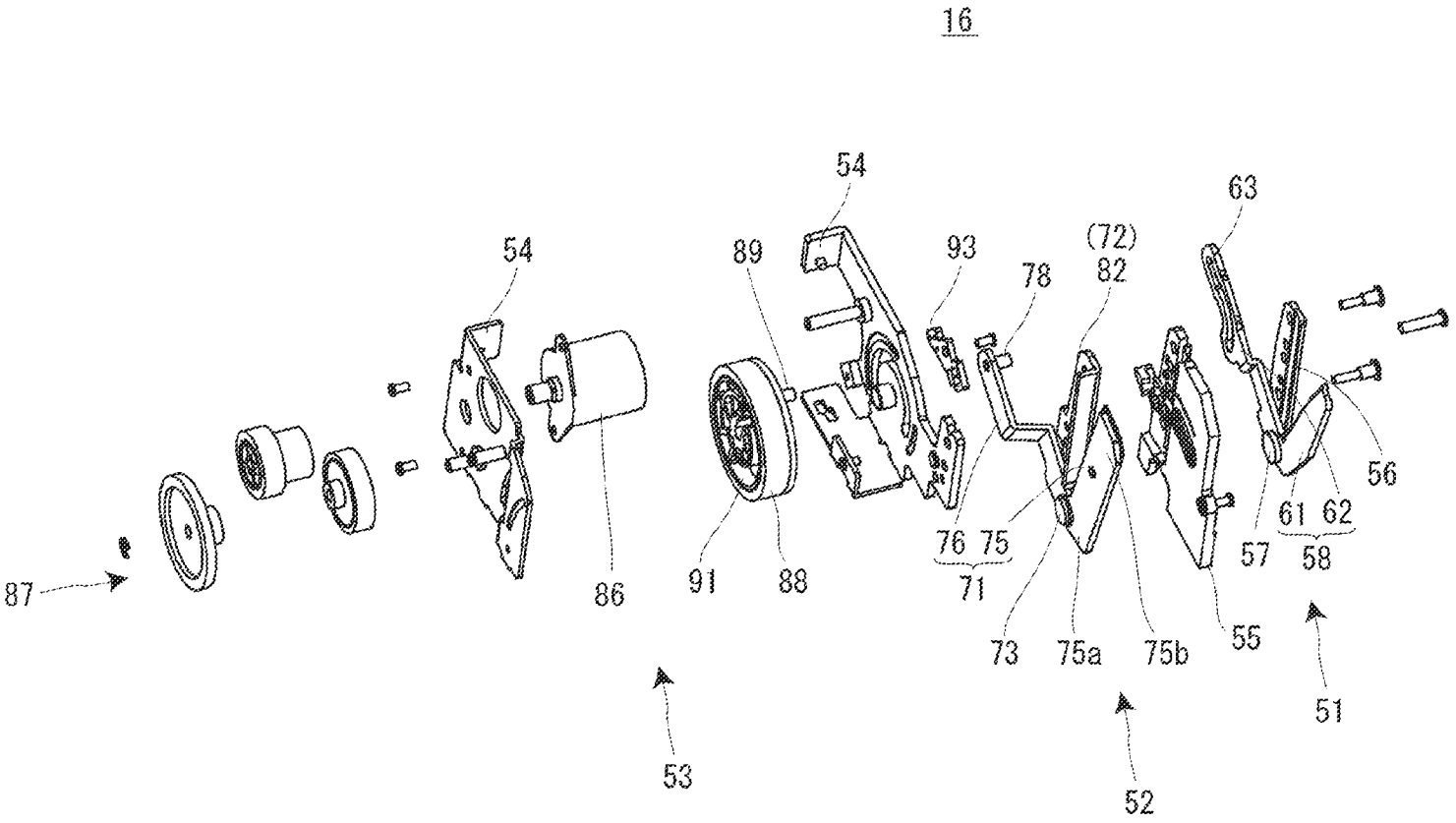
FIG. 7 is an exploded view of a cutting unit.
Figure 8:
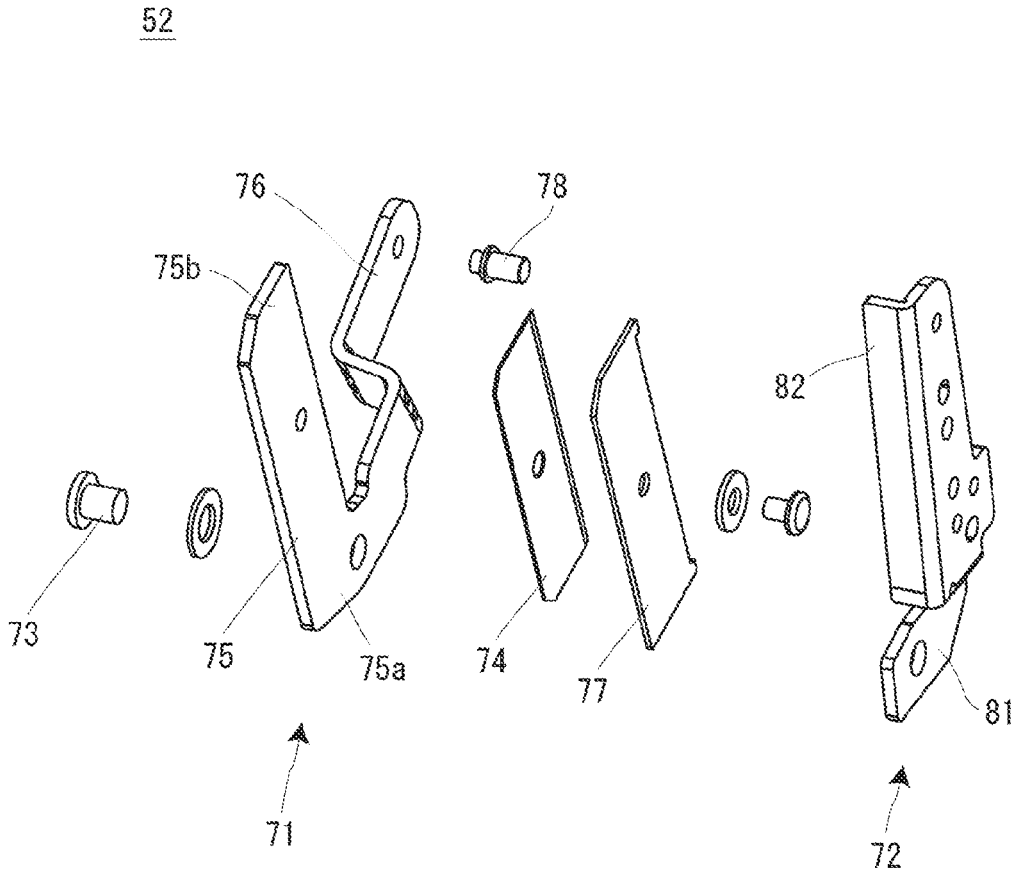
FIG. 8 is an exploded view of a half cutter.
Figure 9A:
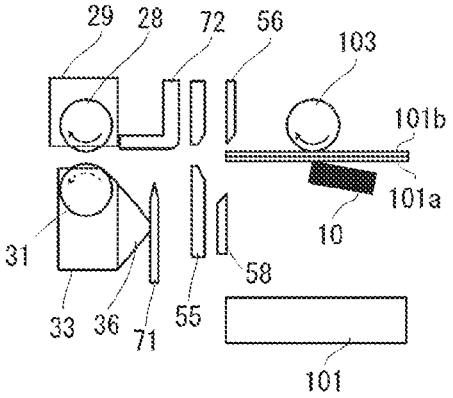
FIGS. 9A to 9E are drawings illustrating a printing process in the tape printing apparatus of the embodiment.
Figure 9D:
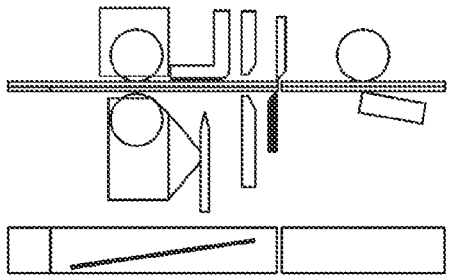
Figure 9B:
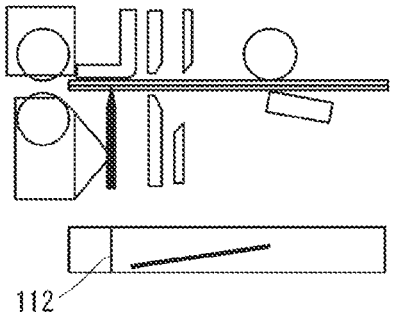
Figure 9E:
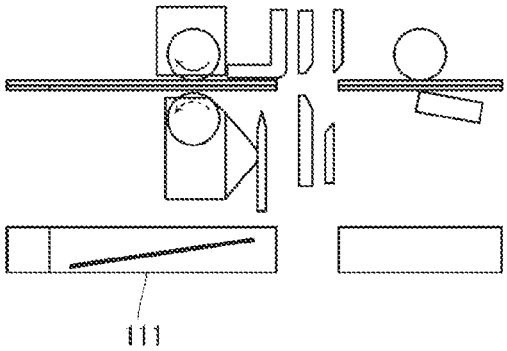
Figure 9C:
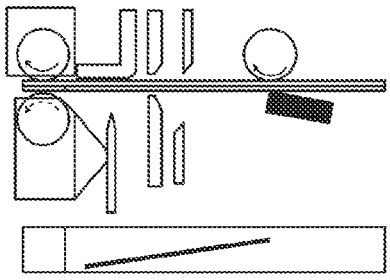

As illustrated in FIG. 6, the feed drive unit 40 is provided with a feed motor 41 as a drive source and a feed power transmitting mechanism 42 configured to transmit a rotational power of the feed motor 41 to the discharge drive roller 28. The feed motor 41 and the feed power transmitting mechanism 42 are built into the apparatus frame 43.

The feed motor 41 is configured to be rotatable in a normal direction and a reverse direction, and functions not only as a drive source of the discharge drive roller 28, but also as drive sources of the platen roller 103 and the ribbon winding core 109.

The feed power transmitting mechanism 42 includes a gear train coupled to an output shaft of the feed motor 41, and transmits motive power input from the feed motor 41 to the discharge drive roller 28 and also to the platen drive shaft 11 and the winding drive shaft 14 divergingly.

Although not illustrated, the feed power transmitting mechanism 42 is provided with a clutch mechanism. The clutch mechanism transmits a normal rotational power of the feed motor 41 to the discharge drive roller 28 side and to the platen drive shaft 11 and the winding drive shaft 14 side and, in contrast, transmits a reverse rotational power of the feed motor 41 only to the discharge drive roller 28 side, and not to the platen drive shaft 11 and the winding drive shaft 14 side. With this clutch mechanism, the tape printing apparatus 1 drives the feed motor 41 at the time of printing and feeding action described later, and hence is capable of driving the platen drive shaft 11, and also the discharge drive roller 28 and the winding drive shaft 14 by rotating the feed motor 41 in the normal direction, and is capable of driving only the discharge drive roller 28 by rotating the feed motor 41 in the reverse direction at the time of discharging action.

Referring now to FIG. 3, FIG. 4, FIG. 6, and FIG. 8, the cutting unit 16 will be described. The cutting unit 16 includes the full cutter 51 configured to perform full-cutting on the tape-like member 101, the half cutter 52 configured to perform half-cutting on the tape-like member 101, a cutter drive unit 53 configured to drive the full cutter 51 and the half cutter 52, and a cutter frame 54 configured to support the cutter drive unit 53. A tape guide 55 provided with a slit-shaped passing port where the tape-like member 101 passes between the full cutter 51 and the half cutter 52.

The full cutter 51 is provided with a movable blade 58 rotatably supported by a fixed blade 56 via the fixed blade 56 fixed to the discharge frame 25 described above and a supporting shaft 57 as a swage pin. The movable blade 58 rotates about the supporting shaft 57, and hence the full cutter 51 cuts both of the printing tape 101*a* and the release tape 101*b* in the width direction of the tape-like member 101 by a scissors system.

The movable blade 58 is formed into a substantially L-shape in right side view. The movable blade 58 includes a movable-side blade portion 61 facing the fixed blade 56 described later, and a movable blade proximal portion 62 extending substantially perpendicular from a lower end portion of the movable-side blade portion 61. The movable-side blade portion 61 is provided on the printing tape 101*a* side with respect to the tape-like member 101 passing therethrough. The movable blade proximal portion 62 has an elongated hole 63 extending along an extending direction thereof. A crank projection 89, which will be described later, engages the elongated hole 63 from the downstream side of the feeding direction.

In contrast, the fixed blade 56 is provided on the release tape 101*b* side with respect to the tape-like member 101 passing therethrough.

The half cutter 52 includes the cutting blade 71 configured to perform an action to cut into the tape-like member 101 from the printing tape 101*a* side and a blade receiving member 72 configured to receive the cutting blade 71 cut into the tape-like member 101. The cutting blade 71 is rotatably supported by the blade receiving member 72 via a supporting shaft 73. The half cutter 52 cuts only the printing tape 101*a* in the width direction of the tape-like member 101 by a press-cutting method by pivoting the cutting blade 71 about the supporting shaft 73.

The cutting blade 71 is formed into an L-shape in the right side view in the same manner as the movable blade 58 described above. The cutting blade 71 is provided with a blade portion 75 having a blade 74 provided thereon and a power input unit 76 extending from a lower end portion of the blade portion 75 substantially perpendicularly.

The blade portion 75 is provided on the printing tape 101*a* side with respect to the tape-like member 101 passing therethrough. A blade holder 77 to which the blade 74 having a straight blade is joined is pivotably mounted on the upstream side of the feeding direction of the blade portion 75. When cutting with the cutting blade 71, the blade holder 77 slightly pivots so that a blade line of the blade 74 matches a blade receiving surface of the blade receiving member 72. Accordingly, a mounting error of the blade holder 77 with respect to the blade portion 75 is canceled. The supporting shaft 73 configured to rotatably support the cutting blade 71 is inserted into a base end portion 75*a* of the blade portion 75.

The edge surface 36*a* of the downstream-side restricting portion 36 described above is in contact with a surface of the blade portion 75 on the downstream side of the feeding direction. More strictly, a distal end portion 75*b* of the blade portion 75 is in contact with the downstream-side restricting portion 36. When cutting into the cutting blade 71, the distal end portion 75*b* of the blade portion 75 and the downstream-side restricting portion 36 slide (see FIG. 10A).

The power input unit 76 is bent into a crank shape toward the downstream side of the feeding direction, and an engagement projection 78 configured to engage a crank disk 88 described later protrude at a distal end thereof toward the upstream side of the feeding direction.

The blade receiving member 72 is provided on the release tape 101*b* side with respect to the tape-like member 101 passing therethrough. The blade receiving member 72 is formed substantially into a J-shape on the right side view, and includes a blade receiving proximal portion 81 through which the supporting shaft 73 is inserted, and a blade receiving body 82 extending from a rear end portion of the blade receiving proximal portion 81 upward. The blade receiving body 82 is bent into an inverted L-shape when viewed from above.

The cutting blade 71 is mounted on a surface of the blade receiving proximal portion 81 on the downstream side of the feeding direction. If individual differences are generated among products in angle of the blade receiving proximal portion 81 due to a dimensional error of the blade receiving member 72 or a mounting error of the blade receiving member 72 with respect to the discharge frame 25, individual differences are generated among products in initial position of the cutting blade 71 in the feeding direction. In the case of the product in which the initial position of the cutting blade 71 is deviated in the upstream side of the feeding direction with respect to a target position, the cutting blade 71 is apart from the downstream-side restricting portion 36, and hence movement restraint of the cutting blade 71 by the downstream-side restricting portion 36 may not be effective (detailed description will be given below). Therefore, it is preferable to control the angle of the blade receiving proximal portion 81 strictly.

The cutter drive unit 53 includes a cutter motor 86 as the drive source, and a cutter drive power transmitting mechanism 87 configured to transmit motive power of the cutter motor 86 to the full cutter 51 and the half cutter 52.

The cutter motor 86 is configured to be rotatable in the normal direction and the reverse direction, and is fixed to the cutter frame 54. The cutter drive power transmitting mechanism 87 is composed of a gear train supported by the cutter frame 54. The crank disk 88 is provided at a down most stream portion of the gear train.

The crank disk 88 is an example of an output member of the appended claims.

The crank projection 89 is provided so as to protrude on the crank disk 88 on the upstream side of the feeding direction, that is, on the full cutter 51 side. The crank projection 89 engages the elongated hole 63 of the movable blade proximal portion 62. The crank disk 88 rotates from the initial position in the normal direction, the movable blade 58 pivots, and the movable blade 58 cuts into the tape-like member 101. In contrast, when the crank disk 88 rotates from the initial position in a reverse direction, the movable blade 58 does not pivot.

A guide groove 91 is formed on the downstream side of the feeding direction of the crank disk 88, that is, on the half cutter 52 side. The engagement projection 78 of the power input unit 76 engages the guide groove 91. The crank disk 88 is provided on the upstream side of the feeding direction with respect to the power input unit 76 of the cutting blade 71. When the crank disk 88 rotates in the reverse direction, the cutting blade 71 pivots and the cutting blade 71 cuts into the tape-like member 101. In contrast, in the case where the crank disk 88 rotates from the initial position in the normal direction, the cutting blade 71 does not pivot.

In this manner, when the crank disk 88 rotates from the initial position in the normal direction, the movable blade 58 of the full cutter 51 cuts into the tape-like member 101, and when the crank disk 88 rotates from the initial position in the reverse direction, the cutting blade 71 of the half cutter 52 cuts into the tape-like member 101. In other words, full-cutting is performed by driving the cutter motor 86 to rotate in the normal direction, and half-cutting is performed by driving the cutter motor 86 to rotate in the reverse direction.

A rotational position detection sensor 93 for detecting a rotational position of the crank disk 88 is provided in the vicinity of the crank disk 88. Driving of the cutter motor 86 is controlled on the basis of the result of detection of the rotational position detection sensor 93.

Referring now to FIGS. 9A to 9E, a series of actions at the time of a printing process in the tape printing apparatus 1 will be described. In this embodiment, the tape printing apparatus 1 performs a printing and feeding action, a half-cutting action, the printing and feeding action, a full-cutting action, and a discharging operation in this order at the time of creating one label. Here, the case of printing an oblique line on the tape-like member 101 as an image will be described.

The tape printing apparatus 1 starts the printing and feeding action when an input of "Execute Printing" is issued from the keyboard 4 by a user. In other words, the tape printing apparatus 1 drives the feed motor 41 to rotate in the normal direction to rotate the platen roller 103 and the ribbon winding core 109, and feeds the tape-like member 101 and the ink ribbon 102 nipped between the platen roller 103 and the printhead 10. The tape printing apparatus 1 starts printing on the printing tape 101*a* by causing the printhead 10 to perform heat-generating drive. As described above, by the normal rotation driving of the feed motor 41, the discharge drive roller 28 rotates and the discharge driven roller 31 rotates in association therewith (see FIG. 9A).

The tape printing apparatus 1 stops the printing and feeding action temporarily when the tape-like member 101 is fed by a predetermined amount from the start of feeding of the tape-like member 101, in the middle of printing of a printing image on one label to achieve the half-cutting action. In other words, the tape printing apparatus 1 drives the cutter motor 86 to rotate in the reverse direction to cause the cutting blade 71 of the half cutter 52 to cut into the tape-like member 101, achieves half cutting on the tape-like member 101, and a slit 112 is formed on the printing tape 101*a* (see FIG. 9B).

The tape printing apparatus 1 restarts the printing and feeding action after the half-cutting action. In other words, the tape printing apparatus 1 rotates the platen roller 103 and the ribbon winding core 109 to cause the printhead 10 to perform the heat-generating drive. If the distal end of the tape-like member 101 goes between the discharge drive roller 28 and the discharge driven roller 31, the tape-like member 101 is also fed by the discharge drive roller 28 and the discharge driven roller 31 as well (see FIG. 9C).

If the tape-like member 101 is fed by a predetermined amount after the completion of printing by the printhead 10, the tape printing apparatus 1 stops the printing and feeding action and performs the full-cutting action. In other words, the tape printing apparatus 1 drives the cutter motor 86 to rotate in the normal direction, and causes the movable blade 58 of the full cutter 51 to cut into the tape-like member 101, and separates a printed portion of the printing tape 101*a* (see FIG. 9D).

The tape printing apparatus 1 performs a discharging operation after the full-cutting action. In other words, the tape printing apparatus 1 drives the feed motor 41 to rotate in the reverse direction, rotates the discharge drive roller 28, and discharges the cut off tape strip 111 from the tape discharge port 9 out of the apparatus (See FIG. 9E). With the actions described above, a series of the printing process is terminated. Since the slit 112 is formed in the obtained tape strip 111 by the half-cutting, the user can easily separate the release tape 101*b* from the printed printing tape 101*a* with the slit 112 as a clue.

Figure 4:
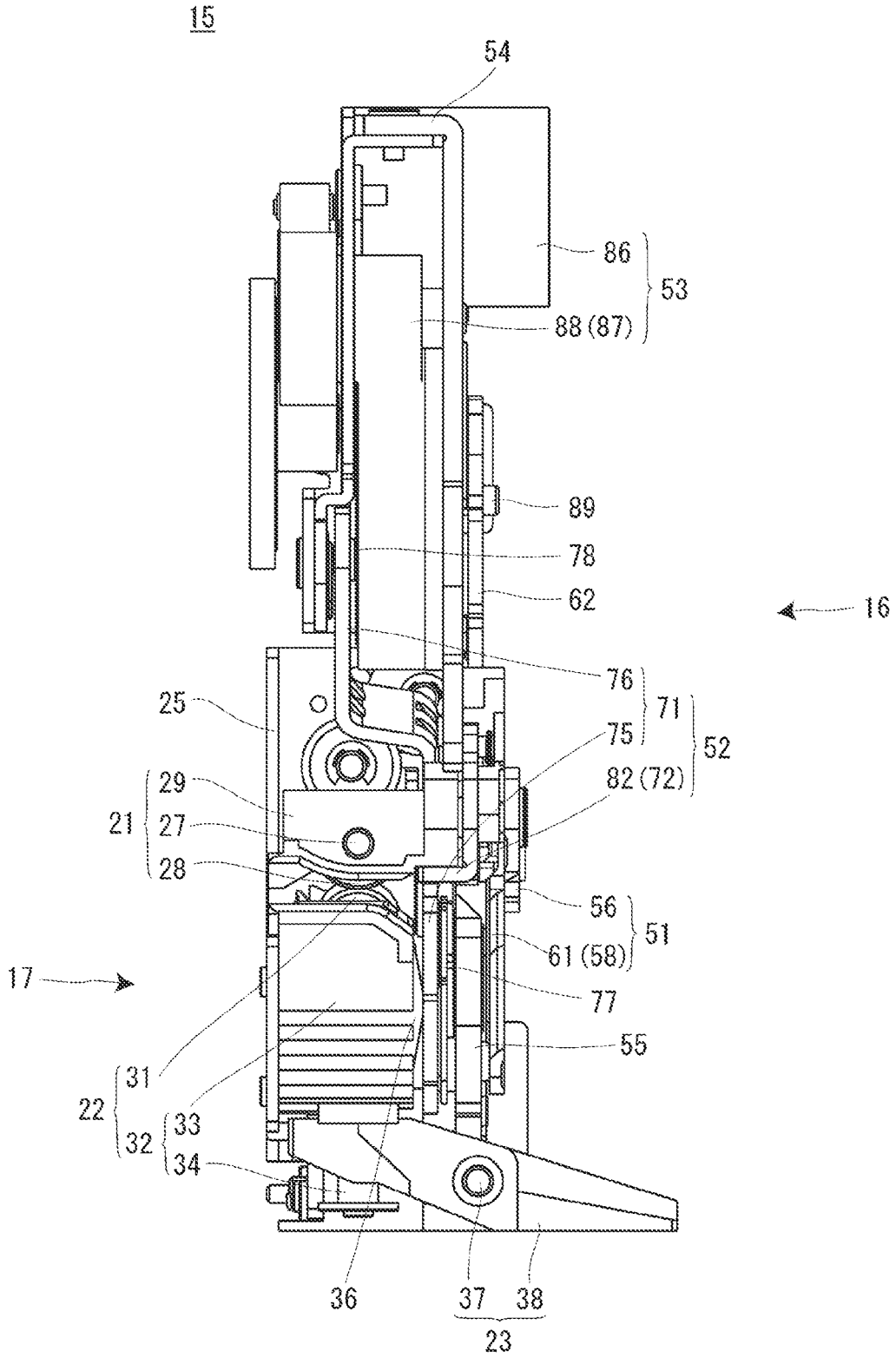
FIG. 4 is a plan view of the cutting-and-discharging unit.
Figure 5:
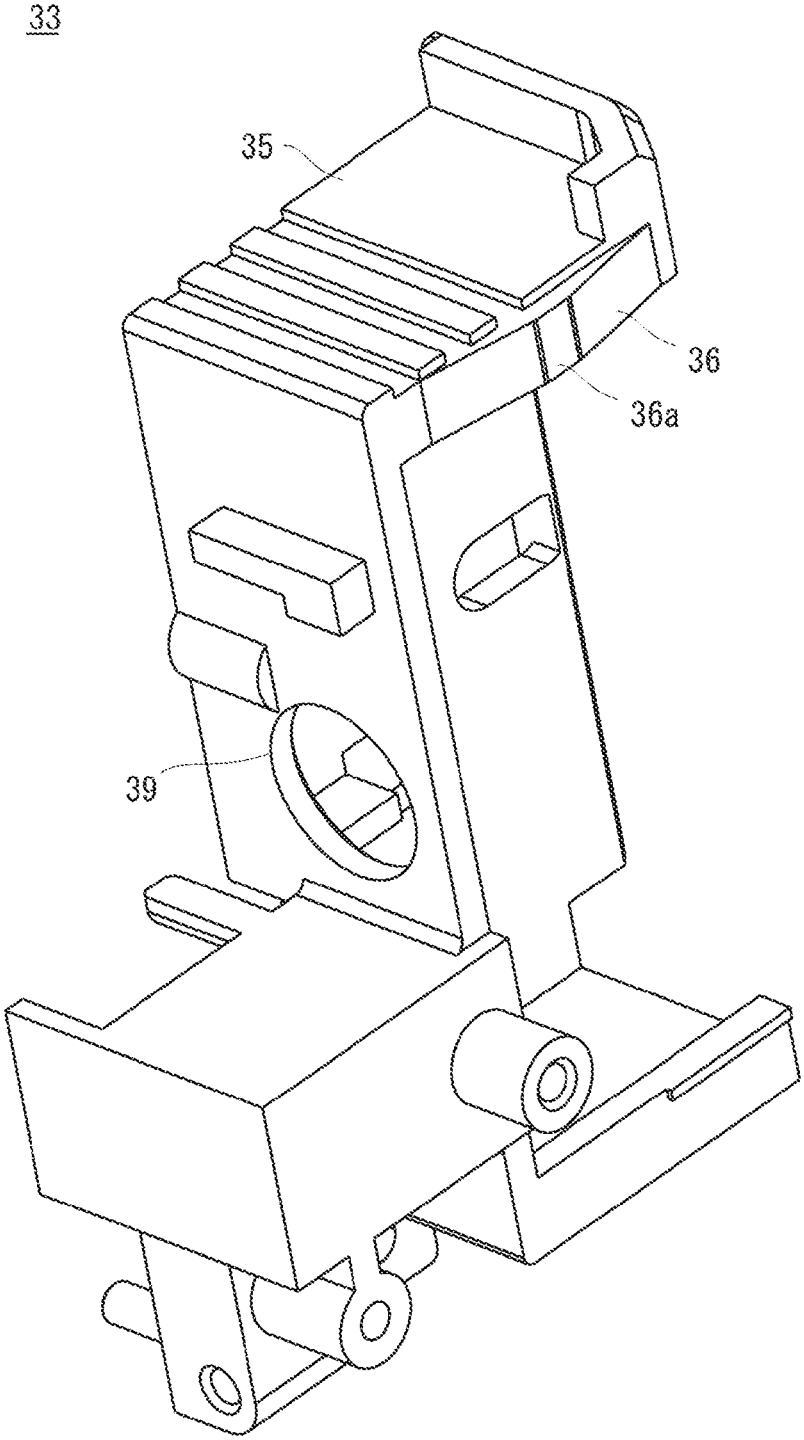
FIG. 5 is a perspective view of a fixed holder.

As described above, the crank disk 88 of the cutter drive unit 53 is provided on the upstream side of the feeding direction with respect to the power input unit 76 of the cutting blade 71 (See FIG. 4). Therefore, the cutting blade 71 can hardly move toward the side where the crank disk 88 is provided with respect to the power input unit 76, that is, toward the upstream side of the feeding direction, but can easily move toward the downstream side of the feeding direction when cutting into the tape-like member 101.

The printhead 10 and the platen drive shaft 11 is provided on the upstream side of the feeding direction with respect to the half cutter 52. Therefore, at the time of the half-cutting action, the tape-like member 101 is nipped between the printhead 10 and the platen roller 103 on the upstream side of the feeding direction with respect to the half cutter 52. Therefore, even when the cutting blade 71 cutting into the tape-like member 101 moves toward the upstream side of the feeding direction, the tape-like member 101 can hardly move toward the upstream side of the feeding direction. In other words, even though the cutting blade 71 is moved in the upstream side of the feeding direction, the tape-like member 101 is simply deflected between the cutting blade 71 and the printhead 10 and the platen roller 103, and the deflected tape-like member 101 is restored to the original state after the cutting operation of the cutting blade 71, the tape-like member 101 does not move in the upstream side of the feeding direction. In contrast, in the case where the cutting blade 71 cutting into the tape-like member 101 moves toward the downstream side of the feeding direction, the tape-like member 101 can easily move toward the downstream side of the feeding direction so as to be dragged by the cutting blade 71. In other words, in the case where a pulling force of the tape-like member 101 by the movement of the cutting blade 71 toward the downstream side of the feeding direction overcomes a nipping force by the printhead 10 and the platen roller 103, the tape-like member 101 moves toward the downstream side of the feeding direction.

Figure 10A:
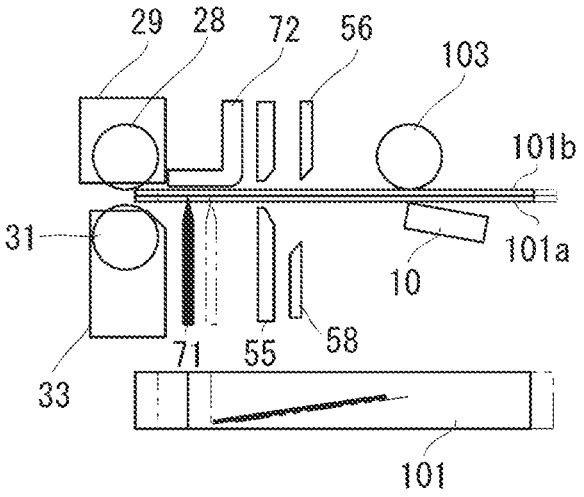
FIG. 10A [RELATED ART]
FIGS. 10A and 10B are drawings illustrating a printing process in a tape printing apparatus of the related art.
Figure 10B:
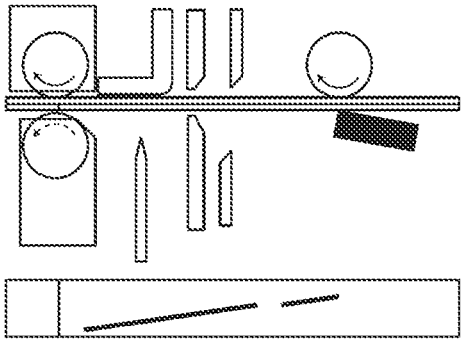

In this manner, in the case of the tape printing apparatus 1 of this embodiment, when the downstream-side restricting portion 36 is supposed not to be provided at the time of the half-cutting action, the cutting blade 71 cutting into the tape-like member 101 may move toward the downstream side of the feeding direction, whereby the tape-like member 101 may move toward the downstream side of the feeding direction correspondingly (see FIG. 10A). In this case, a gap is generated between the image printed by the printing and feeding action before the half-cutting action, and the image printed by the printing and feeding action after the half-cutting action by an amount corresponding to the movement of the tape-like member 101 in the downstream side of the feeding direction at the time of the half-cutting action, which may results in lowering of the print quality (see FIG. 10B).

Accordingly, since the tape printing apparatus 1 of the embodiment is provided with the downstream-side restricting portion 36, even when a force to move the cutting blade 71 cut into the tape-like member 101 toward the downstream of the feeding direction is applied to the cutting blade 71, the cutting blade 71 is restricted from moving in downstream side of the feeding direction. Accordingly, the tape-like member 101 is restrained from moving in the downstream side of the feeding direction at the time of the half-cutting action (see FIG. 9B). Therefore, generation of the gap between the image printed by the printing and feeding action before the half-cutting action and the image printed by the printing and feeding action after the half-cutting action may be restrained (see FIG. 9C).

Also, since the cutting blade 71 is supported by the supporting shaft 73 at a base end portion 75*a* of the blade portion 75, an amount of movement is larger at the distal end portion 75*b* of the blade portion 75 in comparison with the base end portion 75*a* of the blade portion 75 if there is no downstream-side restricting portion 36. However, since the distal end portion 75*b* of the blade portion 75 is in contact with the downstream-side restricting portion 36, the blade portion 75 is effectively restrained from the movement to the downstream side of the feeding direction. As a matter of course, for example, the downstream-side restricting portion 36 may be in contact with an intermediate portion of the blade portion 75, and may be in contact with the power input unit 76 of the cutting blade 71. The distal end portion 75*b* of the blade portion 75 needs not to be always in contact with the downstream-side restricting portion 36, and the cutting blade 71 may be configured such that the movement of the cutting blade 71 in the downstream side of the feeding direction is restricted by the downstream-side restricting portion 36 coming into contact with the distal end portion 75*b* of the blade portion 75 at the time of the half-cutting action.

In the tape printing apparatus 1 of the embodiment, since the fixed holder 33 having the downstream-side restricting portion 36 provided thereon is formed of the material having a higher sliding property than the apparatus case 2, a sliding resistance between the cutting blade 71 and the downstream-side restricting portion 36 is small when the cutting blade 71 cuts into the tape-like member 101. Therefore, the cutting blade 71 may be caused to desirably cut into the tape-like member 101.

Figure 11A:
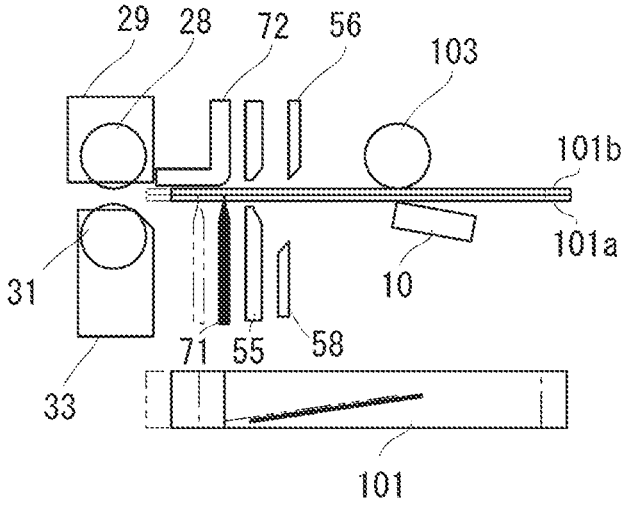
FIG. 11A [RELATED ART]
FIGS. 11A and 11B are drawings illustrating the printing process in the tape printing apparatus of another related art.
Figure 11B:
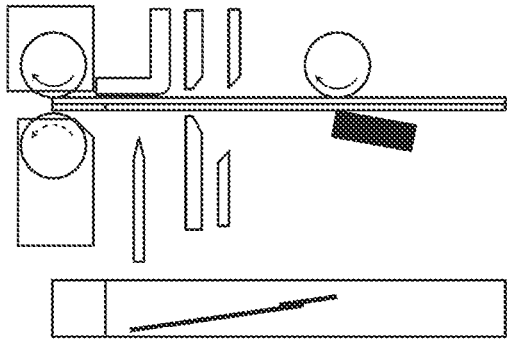

In contrast to the tape printing apparatus 1 of the embodiment, in the case where the cutting blade 71 cutting into the tape-like member 101 at the time of half-cutting action may move toward the upstream side of the feeding direction, whereby the tape-like member 101 may move in the upstream side of the feeding direction (see FIG. 11A), the image printed by the printing and feeding action before the half-cutting action and the image printed by the printing and feeding action after the half-cutting action are partly overlapped by an amount corresponding to the movement of the tape-like member 101 toward the upstream side of the feeding direction at the time of the half-cutting action, which may results in lowering of the print quality (see FIG. 11B).

Figure 12A:
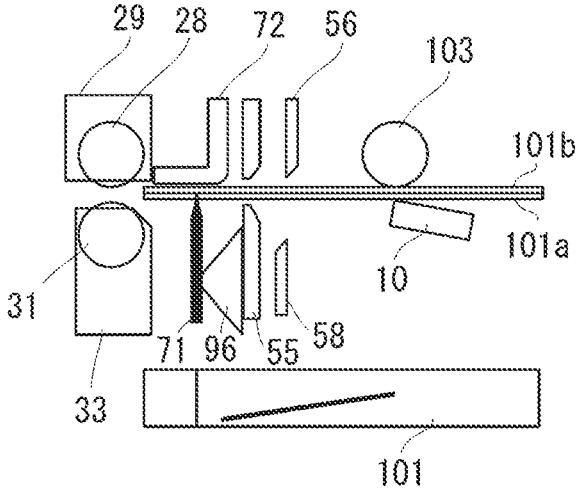
FIGS. 12A and 12B are drawings illustrating a printing process in the tape printing apparatus according to a modification of the invention.
Figure 12B:
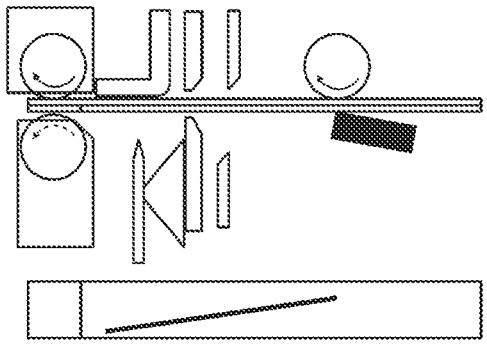

Accordingly, as illustrated in FIGS. 12A and 12B, the tape printing apparatus 1 according to a modification includes an upstream-side restricting portion 96 provided on the upstream side of the cutting blade 71. Accordingly, even when a force to move the cutting blade 71 cut into the tape-like member 101 toward the upstream side of the feeding direction is applied to the cutting blade 71, the cutting blade 71 is restricted from moving in the upstream side of the feeding direction. Accordingly, the tape-like member 101 is restrained from moving in the upstream side of the feeding direction at the time of the half-cutting action (see FIG. 12A). Therefore, partial overlap between the image printed by the printing and feeding action before the half-cutting action and the image printed by the printing and feeding action after the half-cutting action may be restrained (see FIG. 12B).

The downstream-side restricting portion 36 and the upstream-side restricting portion 96 are examples of a "cutter restricting portion" of the appended claims. Both of the downstream-side restricting portion 36 and the upstream-side restricting portion 96 may be provided as the cutter restricting portion as a matter of course.

In the embodiment, the tape printing apparatus 1 of a standalone type is exemplified. However, a configuration connected to an information processing apparatus such as personal computers, mobile terminals and the like via wire or wireless, and printed an image on the tape-like member 101 on the basis of a printing data transmitted from the information processing apparatus is also applicable.

What is claimed is:

1. A tape printing apparatus comprising:

a feed unit configured to feed a tape-like member having a printing tape to be printed and a release tape adhered to the printing tape;

a half cutter having a cutting blade configured to cut into the tape-like member and a blade receiving member configured to receive the cutting blade cut into the tape-like member, and configured to cut one of the printing tape and the release tape in a width direction; and a cutter restricting portion having at least one of an upstream-side restricting portion provided on an upstream side of a feeding direction of the tape-like member with respect to the cutting blade and configured to restrict a movement of the cutting blade cut into the tape-like member in the upstream side of the feeding direction, and a downstream-side restricting portion provided on a downstream side of the feeding direction of the tape-like member with respect to the cutting blade and configured to restrict the movement of the cutting blade cut into the tape-like member in the downstream side of the feeding direction, wherein the at least one of the upstream-side restricting portion and the downstream-side restricting portion remains in contact with the cutting blade as the cutting blade moves relative to the at least one of the upstream-side restricting portion and the downstream-side restricting portion while cutting into the tape-like member.

2. The tape printing apparatus according to claim 1, further comprising:

a printhead configured to perform printing on the printing tape fed by the feed unit, wherein the cutting blade cuts into the tape-like member in the middle of printing on the printing tape by the printhead.

3. The tape printing apparatus according to claim 1, further comprising:

a cutter drive unit configured to drive the cutting blade, wherein the cutting blade includes a blade portion provided with a blade, and a power input unit to which motive power of the cutter drive unit is input, and the cutter restricting portion restrains a movement of the cutting blade by coming into contact with the blade portion.

4. The tape printing apparatus according to claim 3, wherein the cutting blade is supported by the supporting shaft at a base end portion of the blade portion, and the cutter restricting portion comes into contact with a distal end portion of the blade portion so that the movement of the cutting blade is restricted.

5. The tape printing apparatus according to claim 4, wherein the at least one of the upstream-side restricting portion and the downstream-side restricting portion does not contact the base end portion of the blade portion.

6. The tape printing apparatus according to claim 1, wherein the cutter restricting portion includes the downstream-side restricting portion.

7. The tape printing apparatus according to claim 6, further comprising:

a printhead configured to performing printing on the printing tape, wherein the feed unit includes a roller drive shaft configured to drive a roller configured to rotate to feed the tape-like member nipped with the printhead, and the printhead and the roller drive shaft are provided on the upstream side of the feeding direction with respect to the half cutter.

8. The tape printing apparatus according to claim 6, further comprising:

a cutter drive unit configured to drive the cutting blade, wherein the cutting blade includes a blade portion provided with a blade, and a power input unit to which the motive power of the cutter drive unit is input, and an output member of the cutter drive unit engaged the power input unit is provided on the upstream side of the feeding direction with respect to the power input unit.

9. The tape printing apparatus according to claim 6, further comprising:

a full cutter configured to cut the tape-like member and a tape discharging unit provided on the downstream side of the feeding direction with respect to the half cutter, and configured to discharge the tape-like member cut by the full cutter out of the apparatus wherein the tape discharging unit includes a discharge roller configured to rotate to feed the tape-like member, and a roller holder configured to rotatably support the discharge roller, and the downstream-side restricting portion is provided on the roller holder.

10. The tape printing apparatus according to claim 9, further comprising:

an apparatus case as an outer shell of the apparatus, wherein the roller holder is formed of a material having a higher sliding property than the apparatus case.

11. The tape printing apparatus according to claim 1, wherein a portion of the cutting blade slides over an abutting end surface of the at least one of the upstream-side restricting portion and the downstream-side restricting portion while cutting into the tape-like member.

12. The tape printing apparatus according to claim 1, the at least one of the upstream-side restricting portion and the downstream-side restricting portion remains in contact with the cutting blade prior to and following cutting into the tape-like member.

13. The tape printing apparatus according to claim 1, the at least one of the upstream-side restricting portion and the downstream-side restricting portion tapers from a narrower portion contacting the cutting blade to a wider portion disposed away from the cutting blade.

* * * * *